US005167991A

United States Patent [19]

Lowe

[11] Patent Number: 5,167,991

[45] Date of Patent: Dec. 1, 1992

[54] METHOD FOR PRODUCING A REPLICATED STONE SURFACE

[76] Inventor: Michael Lowe, 2634 Firestone Dr., Clearwater, Fla. 34621

[21] Appl. No.: 699,207

[22] Filed: May 13, 1991

[51] Int. Cl.[5] ..... B05D 3/12; B05D 5/00

[52] U.S. Cl. ..... 427/267; 427/270

[58] Field of Search ..... 427/267, 270, 271, 274, 427/277, 262, 264

[56] References Cited

U.S. PATENT DOCUMENTS

| | | | |
|---|---|---|---|
| 2,513,648 | 7/1950 | Iezzi | 264/293 X |
| 3,819,395 | 6/1974 | Yocum | 427/277 X |
| 3,853,577 | 12/1974 | Nishida et al. | 427/270 |

FOREIGN PATENT DOCUMENTS

| | | | |
|---|---|---|---|
| WO86/03433 | 6/1986 | World Int. Prop. O. | 427/267 |

*Primary Examiner*—Evan Lawrence

*Attorney, Agent, or Firm*—A. W. Fisher, III

[57] ABSTRACT

A method for producing a replicated stone surface comprising the steps of preparing a polymer mortar, coating a substrate with the polymer mortar, leveling the polymer mortar to a substantially even thickness, creating a textured surface on the polymer mortar, applying a hydrophobic release agent to the surface of polymer mortar, displacing portions of the polymer mortar by pressing a patterned tool on the surface of the polymer mortar to form the plurality of simulated stones with raised peripheral edges and intervening simulated grout lines, allowing the polymer mortar to cure, applying a pigment to the surface of the plurality of simulated stones and simulated intervening grout lines, buffing the surface of the plurality of simulated stones and simulated intervening grout lines to impregnate the pores thereof with the pigment, abrading the surface of the plurality of simulated stones to create a weathered appearance and sealing the surface of the plurality of simulated stones and simulated intervening grout lines with a sealer to protect the replicated stone surface.

14 Claims, 5 Drawing Sheets

METHOD FOR PRODUCING A REPLICATED STONE SURFACE

BACKGROUND OF THE INVENTION

Description of the Prior Art

The high cost of labor and material have made use of genuine brick, stone and tile in construction prohibitively expensive.

As a result relatively inexpensive polymers and concrete have become popular in the manufacture of artificial brick, stone and tile. Artificial brick surfaces are relatively easy to produce. However the production of aesthetically appealing artificial stone is more difficult. Specifically, replicating the texture resembling real stone and the color is often poor.

U.S. Pat. No. 4,310,370 shows a process for producing decoratiave articles comprising the steps of placing into mutual contact and laminating a hardenable decorative material layer and an expansion-contraction deformable sheet provided with regions susceptible to expansion-contraction deformation and regions not susceptible to deformation; causing the deformable sheet to undergo deformation under pressure to impart a pattern of unevennesses to the decorative material layer in contact with the sheet; and causing the hardenable decorative material layer to fully harden. The sheet deformed under pressure imparts a pattern of surface unevenness corresponding to the two kinds of regions to the decorative material layer. The degree or surface unevenness can be controlled by adjusting the pressure. Colored patterns corresponding to the unevennesses can also be formed.

U.S. Pat. No. 3,836,619 describes a method of forming an artificial stone comprising the steps of providing a flexible mold; pouring a curable mixture of polyester plastic and catalyst in the mold to form a polyester plastic body having a configured surface; scraping off excess of the curable mixture by applying sufficient pressure to depress the exdges of the mold and form a raised lip on the plastic body; curing the mixture; removing the plastic body from the mold; spraying the configured surface with a liquid color layer and drying; spraying the color layer with a curable, transparent, liquid coat and curing said coat until the outer surface is gelled; spraying a thin layer of sand on the outer surface of said transparent coat, and curing the transparent coat, thereby bonding the sand layer to the transparent coat layer.

U.S. Pat. No. 4,349,588 teaches a method for producing simulated brick, tile wall or floor using cement, water-based adhesive and water insoluble powdered pigment. The mixture is applied and then partially set. Scoring indentations are made to remove cement. After being completely set, mortar is placed in the indentations as a grout and allowed to set. The final step is a clear water-resistant coating on the entire surface.

U.S. Pat. No. 4,126,727 shows a resinous polymer sheet material having selective, decorative effects comprising a first layer of a resinous polymer composition; a pattern or design printed on and adhered to the surface of the first layer of resinous polymer composition and having relatively dark colored printed portions and relatively light colored printed portions. A second layer of a resinous polymer composition is applied on and adhered to the printed pattern or design and to the first layer of resinous polymer composition. The second layer of resinous polymer composition includes a layer of relatively small, flat, decorative chips or flakes comprising a very thin layer of translucent or transparent platelets provided with coating. Light wave interference and color absorptive effects are created as light waves strike and reflect from the second layer of resinous polymer composition whereby the decorative chips or flakes located over the relatively dark colored printed portions are discernible from eye-level or a distance of about five feet whereas those decorative chips or flakes located over the relatively light colored printed portions are indiscernible from eye-level or a distance of about five feet.

U.S. Pat. No. 4,105,816 describes a decorative relief finished surface formed to a substrate by applying an undercoat material to a predetermained thickness and forming an uneven pattern with a rolling device having a plurality of convex parts of curved continued, disconnected to perforated line shape. Then, the top portions of the projections of the partially hardened surface which extend beyond a predetermined height are pressed with a pressing roll such that the projections are uniformly flattened to a predetermained thickness while the rest of the convex parts are left unflattened.

U.S. Pat. No. 3,882,218 shows embossed decorative patterns and decorative laminates, particularly textured film finished structural elements and the method of manufacture wherein a resilient material such as a wadding sheet or pad sheet is interposed between the surface film and the substrate.

U.S. Pat. No. 3,152,002 describes a process of making elastomeric flooring of varigated color comprising the steps of coating a sheet of backing material with a liquid polyvinyl chloride plastisol, delivering a charge of solid unheated plastic granules of polyvinyl chloride compound and different colors to the coated backing sheet, spreading the granules in a layer of substantially uniform thickness in the liquid plastisol, partially curing the plastisol to fix the position of the granules on the backing sheet and then molding the components into a product of the desired surface texture.

U.S. Pat. No. 3,012,285 teaches a process of producing an elastomeric covering for floors, walls and the like comprising the steps of mixing a plurality of moldable vinyl elastomers of different shades of the same base color, calendering the mixture to form a solid mottled sheet of the selected colors, heating the calendered elastomeric sheet to molding temperature, molding the overall surface area of the sheet by applying a mold having a plurality of scattered low protuberances of irregular outline and of varying size, depth, configuration and distribution, removing the mold from the molded sheet, coating the molded surface of the elastomeric sheet with a paint of a color contrasting with the base color and then removing the colored paint immediately to expose plane surface areas of the molded elastomeric sheet while leaving the depressed areas of the cavities thereof permanently coated with the contrasting colored paint.

U.S. Pat. No. 2,577,241 shows a method of producing a face configuration of variable pattern which comprises impressing in the face of deformable material a textured surface element having a definite face pattern to thereby provide the deformable material with a face presenting a complete pattern complemental to the pattern of the element and then impressing on the deformable material face to a less depth a textured surface element in random relation to the complemental pattern to randomly modify the pattern of said material face while maintaining the general texture resulting from the first impression.

Additional examples of the prior art are found in U.S. Pat. No. 2,955,324; U.S. Pat. No. 3,839,514 and U.S. Pat. No. 3,848,043.

SUMMARY OF THE INVENTION

The present invention relates to a method for producing a replicated stone surface with coloration and texture replicating natural stone.

The replicated stone surface comprises a layer of polymer material adhered to a substrate such as concrete slab or wall structure including a plurality of simulated stones and simulated intervening grout lines sealed with an acrylic polymer sealer to protect the replicated stone surface from the environment.

The method for producing the replicated stone surface comprises the steps of preparing a polymer mortar, coating a substrate with the polymer mortar, leveling the polymer mortar to a substantially even thickness, creating a textured surface on the polymer mortar, applying a hydrophobic release agent to the surface of polymer mortar, displacing portions of the polymer mortar by pressing a patterned tool on the surface of the polymer mortar to form the plurality of simulated stones with raised peripheral edges and intervening simulated grout lines, allowing the polymer mortar to cure, applying a pigment to the surface of the plurality of simulated stones and simulated intervening grout lines, buffing the surface of the plurality of simulated stones and simulated intervening grout lines to impregnate the pores thereof with the pigment, abrading the surface of the plurality of simulated stones to create a weathered appearance and sealing the upper surface of the plurality of simulated stones and simulated intervening grout lines with the acrylic polymer sealer to protect the replicated stone surface.

To produce the polymer mortar, silica sand, Portland cement, iron oxide pigment and surfactant are introduced into a mixer. These components are thoroughly mixed. Then water and an acrylic polymer are added to the mixer and thoroughly mixed to produce a homogeneous polymer mortar.

The homogeneous polymer mortar is poured onto or otherwise applied directly to the substrate. The homogeneous polymer mortar is then leveled to a substantially even thickness of ⅛ inch to ¼ inch.

The upper surface of the mortar is randomly scraped to create a textured surface. A dry granular hydrophobic release agent is applied to the upper surface of the polymer mortar to prevent the polymer mortar from sticking to a patterned tool used to form the plurality of simulated stones with raised peripheral edges and intervening simulated grout lines by displacing portions of the polymer mortar. The polymer mortar is then allowed to cure.

An antiquing pigment is applied to the upper surface of the plurality of simulated stones and simulated intervening grout lines and buffed to impregnate the pores thereof with the antiquing pigment.

The raised peripheral edges are abraded to create a natural, weathered appearance. The upper surface of the plurality of simulated stones and simulated intervening grout lines are coated by applying the clear acrylic polymer water resistant sealer to protect the replicated stone surface. Once the acrylic polymer sealer hardens to a wear bearing surface, the replicated stone surface is ready for traffic.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The present invention relates to a method for producing the replicated stone surface 10. As described more fully hereinafter, the method produces a thin layer replicated stone surface 10 from ⅛ inch to ¼ inch in thickness with coloration and texture replicating natural stone.

Figure 1:
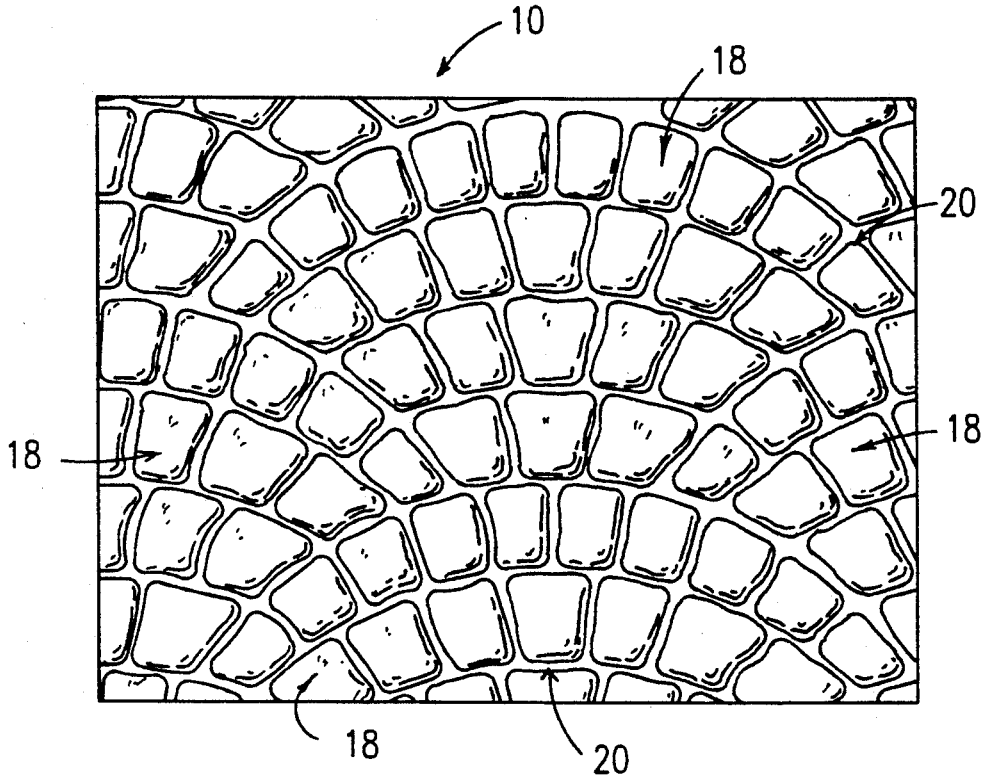
FIG. 1 is a top view of the replicated stone surface.
Figure 2:
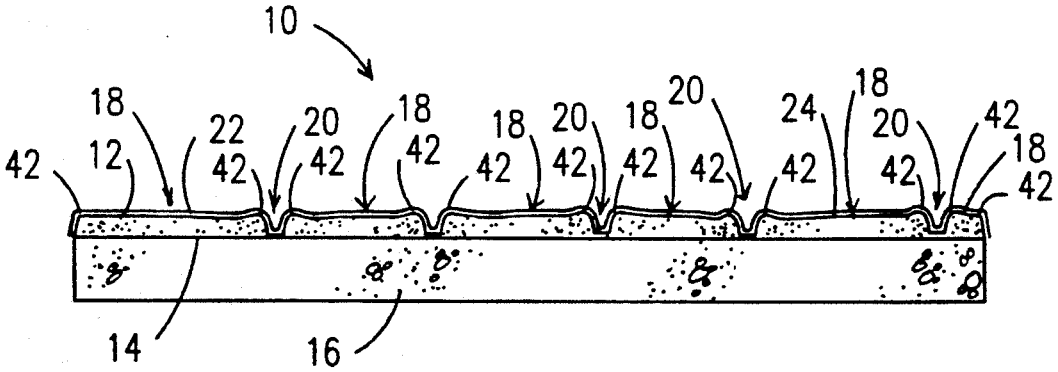
FIG. 2 is a cross-sectional view of the replicated stone surface.

As best shown in FIG. 2, the replicated stone surface 10 comprises a layer of cementitious polymer material 12, the lower surface 14 of which is adhered to a substrate 16 such as concrete slab or wall structure including a plurality of simulated stones each generally indicated as 18 and simulated intervening grout lines each indicated as 20 formed in the upper surface 22 thereof. The plurality of simulated stones 18 and simulated intervening grout lines 20 are sealed with an acrylic thermal plastic sealer 24 to protect the replicated stone surface 10 from the environment.

Figure 3:
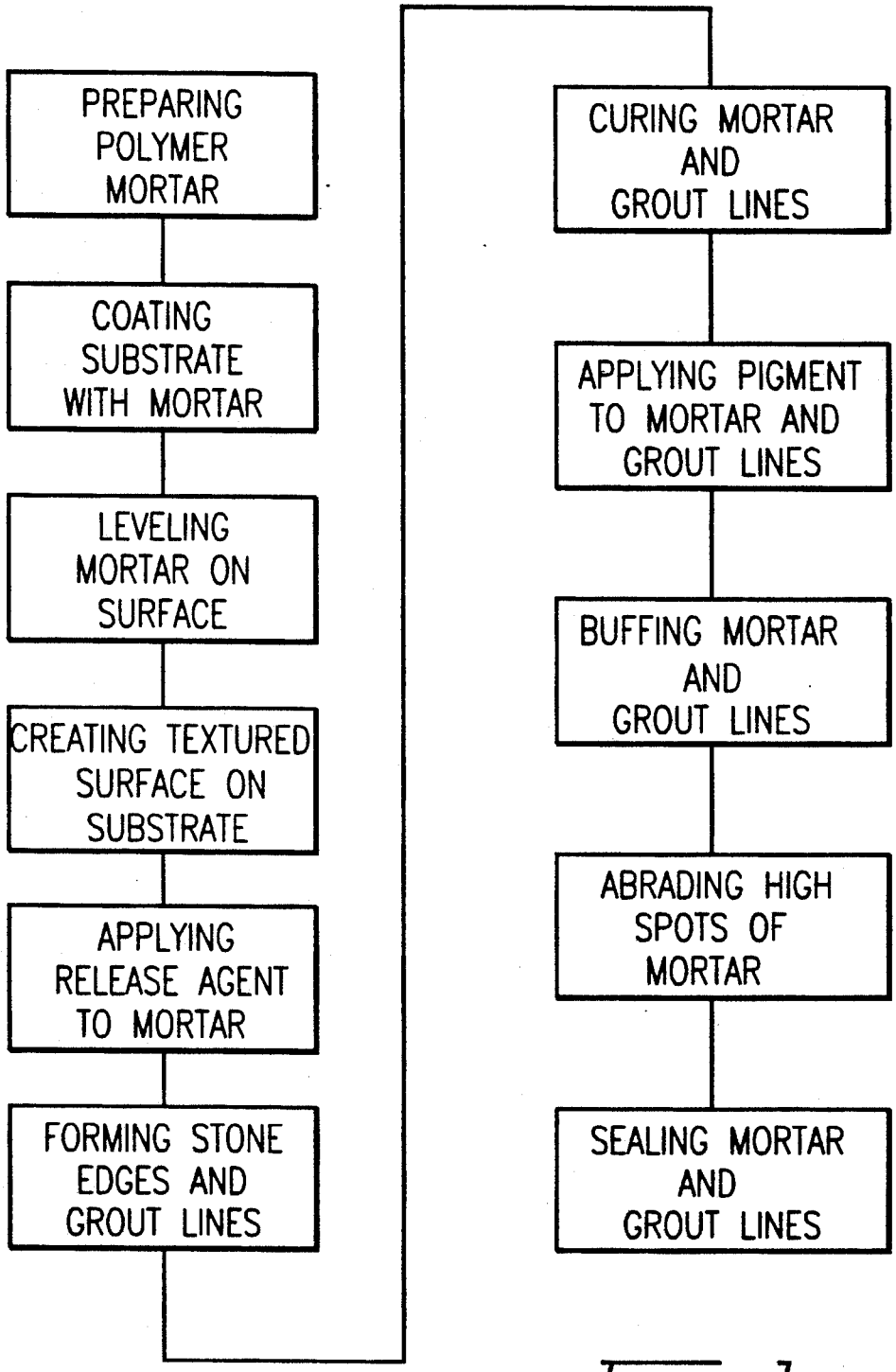
FIG. 3 is a flow chart of the steps of the method for producing the replicated stone surface.

FIG. 3 is a flow chart of the method for producing the replicated stone surface 10 comprising the steps of preparing the cementitious polymer mortar 12, coating a substrate with the cementitious polymer mortar 12, leveling the cementitious polymer mortar 12 to a substantially even thickness, creating a textured surface on the cementitious polymer mortar 12, applying a hydrophobic release agent to the surface of cementitious polymer mortar 12, displacing portions of the cementitious polymer mortar 12 by pressing a patterned tool on the surface of the cementitious polymer mortar 12 to form the plurality of simulated stones 18 with raised peripheral edges and intervening simulated grout lines 20, allowing the cementitious polymer mortar 12 to cure, applying a pigment to the surface of the plurality of simulated stones 18 and simulated intervening grout lines 20 buffing the surface of the plurality of simulated stones 18 and simulated intervening grout lines 20 to impregnate the pores thereof with the pigment, abrading the surface of the plurality of simulated stones 18 to create a weathered appearance and sealing the upper surface 22 of the plurality of simulated stones 18 and simulated intervening grout lines 20 with the acrylic thermal plastic sealer 24 to protect the replicated stone surface 10.

Figure 4:
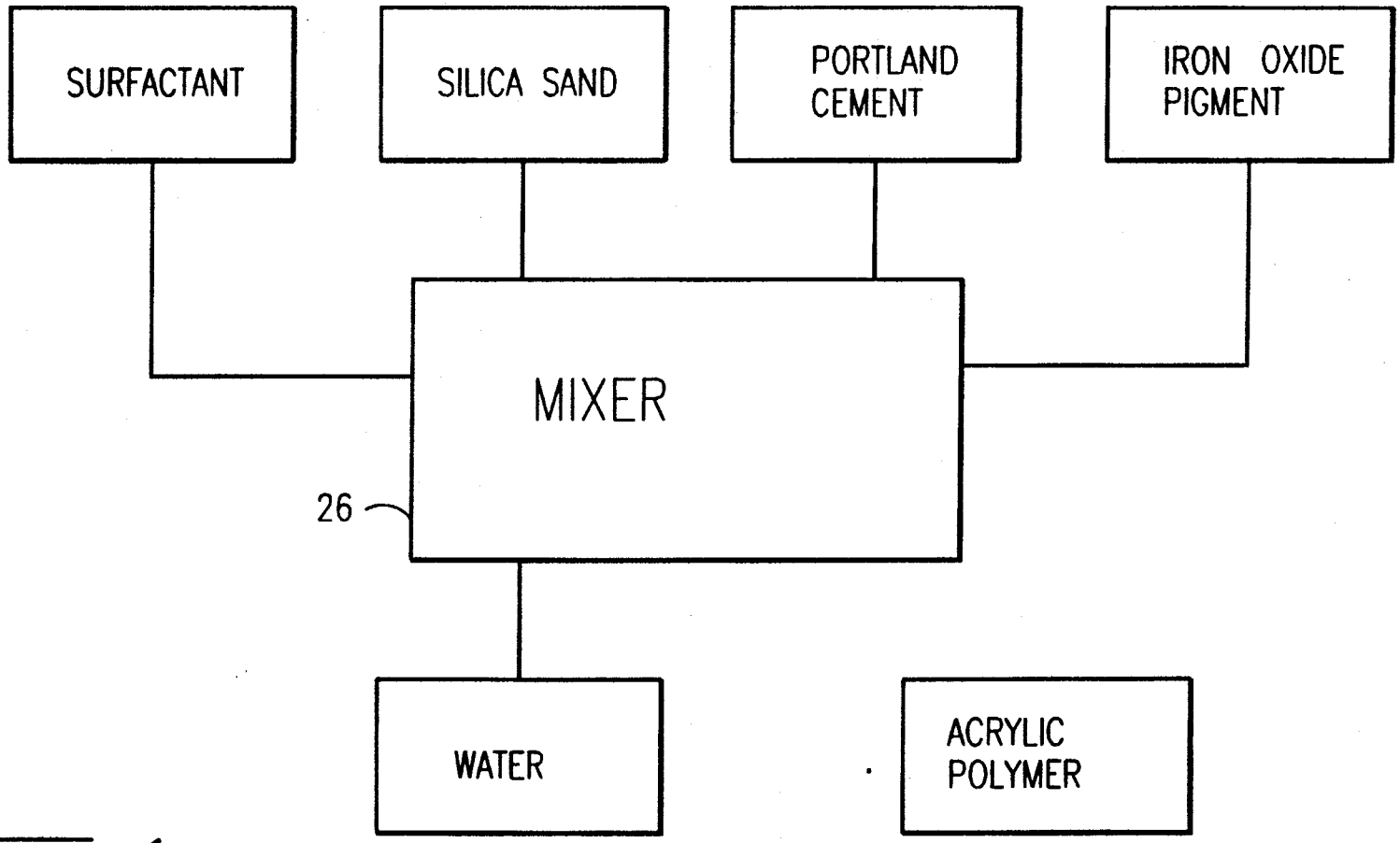
FIG. 4 is a schematic of the steps of preparing the polymer mortar used in the production of the replicated stone surface.

FIG. 4 is a schematic depicting the preparation of the cementitious polymer mortar 12. To produce a unit of the cementitious mortar 12, a dry mixture comprising 30 pounds of silica sand with a gradation of 40/65 F screening, 20 pounds of Portland cement, 0.1 to 0.5 pounds of iron oxide pigment as a base color and 0.325 pounds of surfactant or wetting agent to aid in uniform distribution of the iron oxide pigment are introduced into a mixer 26. Three quarts of water and three quarts of acrylic polymer are then added to the dry mixture and thoroughly mixed to produce the homogeneous cementitious polymer mortar 12.

Figure 5:
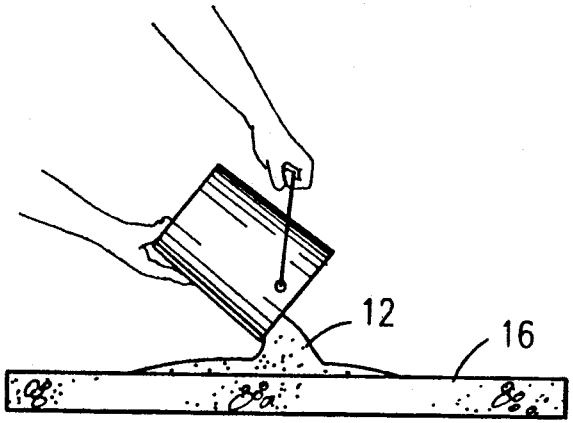
FIGS. 5 through 12 show the individual steps of the method for producing the replicated stone surface.
Figure 6:
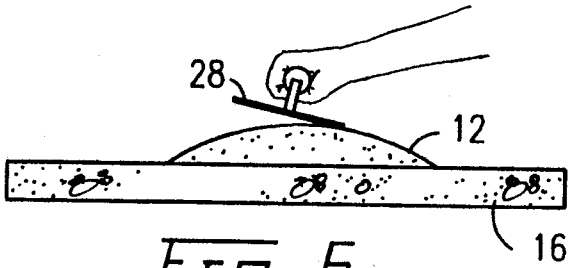

As shown in FIG. 5, the homogeneous cementitious polymer mortar 12 is poured onto or otherwise applied directly to the substrate 16. The homogeneous cementitious polymer mortar 12 is then leveled to a substantially even thickness of ⅛ inch to ¼ inch with a trowel 28 as shown in FIG. 6 or by some other suitable means.

Figure 7:
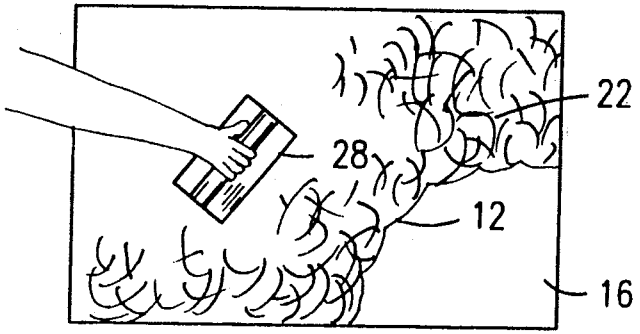

As shown in FIG. 7, the upper surface 22 of the cementitious polymer mortar 12 is randomly shaped with a trowel 28 or other mechanical means to create a textured, layered surface.

Figure 8:
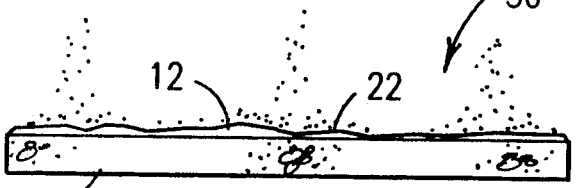
Figure 9:
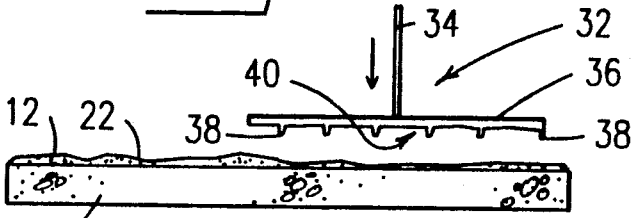
Figure 13:
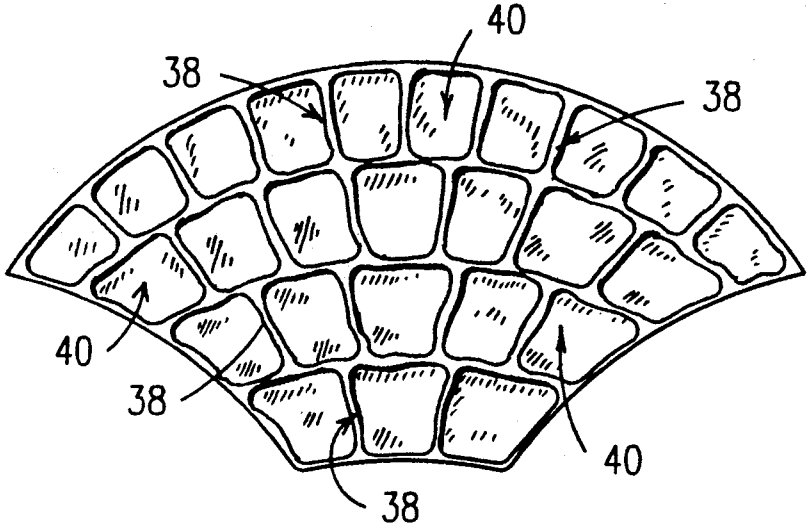
FIG. 13 shows a bottom view of a representative patterned tool.

As shown in FIG. 8, a dry granular hydrophobic release agent 30 is applied to the upper surface 22 of the cementitious polymer mortar 12 to prevent the cementitious polymer mortar 12 from sticking to a patterned tool generally indicated as 32 in FIG. 9. As shown in FIG. 9, portions of the polymer mortar 12 are displaced by pressing the mold 36 onto the surface 22 of the cementitious polymer mortar 12 to form the plurality of simulated stones 18 with raised peripheral irregular edges 42 and intervening simulated grout lines 20 (FIG. 2). As shown in FIGS. 9 and 13, the patterned tool 32 comprises a handle 34 having a mold 36 attached to one end thereof. The mold 36 includes a plurality of raised grout line forming edges each indicated as 38 cooperatively forming a plurality of stone forming cavities each indicated as 40.

The cementitious polymer mortar 12 is then allowed to cure.

Figure 10:
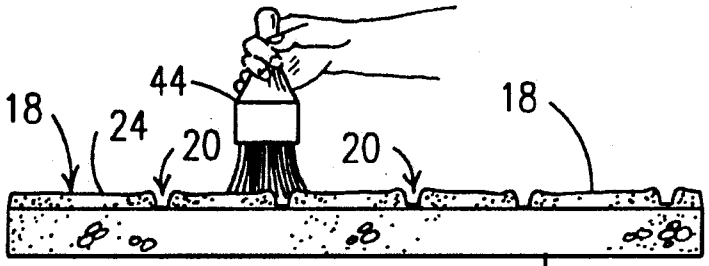

As shown in FIG. 10, an antiquing pigment is applied to the upper surface 22 of the plurality of simulated stones 18 and simulated intervening grout lines 20 with a brush 44 or other suitable means. The upper surface 22 of the plurality of simulated stones 18 and simulated intervening grout lines 20 are then buffed to impregnate the pores thereof with the antiquing pigment thereby creating a variegated or varied color pattern similar to the natural stone color or shading beneath the wear bearing surface.

Figure 11:
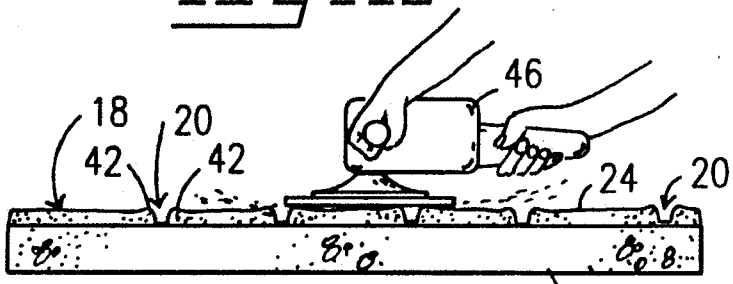

As shown in FIG. 11, the raised peripheral irregular edges 42 and a plurality of simulated stones 18 are abraded with a sander 46 or similar device to randomly smooth portions of the plurality of simulated stones 18 and raised peripheral irregular edges 42 to create a natural, weathered and worn appearance.

Figure 12:
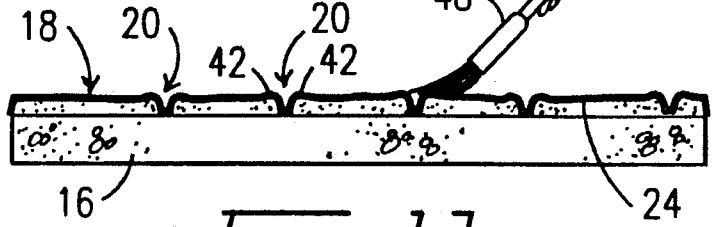

Finally as shown in FIG. 12, the upper surface 22 of the plurality of simulated stones 18 and simulated intervening grout lines 20 are coated by applying the clear acrylic thermal plastic water resistant sealer 24 with a brush, roller or spray 48 to protect the replicated stone surface 10. Once the clear acrylic thermal plastic water resistant sealer 24 hardens, the replicated stone surface 10 is ready for traffic.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A method for producing a replicated stone surface having a wear bearing surface including a plurality of simulated stones and simulated intervening grout lines comprising the following steps in sequential order:

(a) preparing a curable polymer mortar, (b) coating a substrate with the polymer mortar, (c) leveling the polymer mortar to a substantially even thickness, (d) creating a random textured layered surface on the polymer mortar, (e) displacing portions of the polymer mortar by pressing a patterned tool on the random textured layered surface of the polymer mortar to form the plurality of simulated stones with raised peripheral irregular edges and intervening simulated grout lines, (f) allowing the polymer mortar to cure, (g) abrading the random textured layered surface of the plurality of simulated stones to randomly smooth portions of the plurality of simulated stone and raised peripheral irregular edges to create a weathered and worn appearance, and (h) sealing the surface of the plurality of simulated stones and simulated intervening grout lines with a sealer to protect the replicated stone surface and to create a wear bearing surface.

2. The method of claim 1 further comprising the following steps:

(i) applying a release agent to the surface of polymer mortar after creating the random textural layered surface and before displacing portions of the polymer mortar.

3. The method of claim 2 wherein said release agent is hydrophobic.

4. The method of claim 1 further comprising the following step:

(j) applying a pigment to the surface of the plurality of simulated stones and simulated intervening grout lines after curing of the polymer mortar and before abrading the random textured layered surface thereby creating a variegated pattern similar to natural stone coloration beneath the wear bearing surface.

5. The method of claim 4 further comprising the following step:

(k) buffing the surface of the plurality of simulated stones and simulated intervening grout lines after applying the pigment and before abrading to impregnate the pores thereof with the pigment.

6. The method of claim 1 wherein the polymer mortar is leveled to one quarter inch or less in thickness.

7. The method of claim 6 wherein the polymer mortar is leveled to substantially one-eighth inch in thickness.

8. The method of claim 1 wherein said polymer mortar comprises a mixture of water, acrylic polymer, silica sand and Portland cement mixed to a homogeneous cementitious polymer mortar.

9. The method of claim 8 wherein said mixture further includes an iron oxide pigment.

10. The method of claim 8 wherein said mixture further includes a surfactant.

11. The method of claim 8 wherein the silica sand and Portland cement are mixed in a ratio by weight of 3 to 2.

12. The method of claim 8 wherein the water and acrylic polymer are mixed in a ratio by volume of 1 to 1.

13. The method of claim 1 wherein the polymer mortar comprises a mixture of water and acrylic polymer in a relative ratio by volume of 1 to 1, and silica sand, Portland cement and iron oxide pigment in a relative ratio by weight of 30 to 20 to between 0.1 and 0.5, respectively.

14. The method of claim 13 wherein said mixture further includes a surfactant.

* * * * *